United States Patent [19]

Braid

[11] 4,021,470

[45] May 3, 1977

[54] 2,2,4-TRIMETHYLPENTYL-N-NAPHTHYL ANTHRANILATE

[75] Inventor: Milton Braid, Westmont, N.J.

[73] Assignee: Mobil Oil Corporation, New York, N.Y.

[22] Filed: Oct. 30, 1974

[21] Appl. No.: 519,368

Related U.S. Application Data

[60] Division of Ser. No. 337,185, March 1, 1973, Pat. No. 3,856,690, which is a continuation-in-part of Ser. No. 126,891, March 22, 1971, abandoned.

[52] U.S. Cl. ..... 260/471 R; 260/465 D

[51] Int. Cl.[2] ..... C07C 101/54

[58] Field of Search ..... 260/471 R

[56] References Cited

UNITED STATES PATENTS

| | | | |
|---|---|---|---|
| 2,369,090 | 2/1945 | Trautman | 252/51.5 A |
| 2,390,943 | 12/1945 | Kavanagh et al. | 252/51.5 A |
| 3,247,111 | 4/1966 | Oberright et al. | 252/50 X |
| 3,282,840 | 11/1966 | Foster et al. | 252/51.5 A |
| 3,642,632 | 2/1972 | Coburn et al. | 252/51.5 A |
| 3,767,575 | 10/1973 | Braid | 252/51.5 A X |

OTHER PUBLICATIONS

Legrand, et al., Bull. Soc. Chim. Fr., (4) 1969, pp. 1173–1182.

Goldstein, et al., Chemical Abstracts, vol. 39 (1945) 287.

Mathur, et al., Chemical Abstracts, vol. 60 (1964), 5455.

*Primary Examiner*—Richard L. Raymond

*Attorney, Agent, or Firm*—Charles A. Huggett; Raymond W. Barclay; Claude E. Setliff

[57] ABSTRACT

Lubricants are stabilized against oxidative degradation by adding thereto a stabilizing amount of an ester of an anthranilic acid. An example of a suitable material is n-octyl N-naphthylanthranilate (n-octyl N-phenyl-1-naphthyl-2′-carboxylate).

1 Claim, No Drawings

2,2,4-TRIMETHYLPENTYL-N-NAPHTHYL ANTHRANILATE

CROSS REFERENCE TO RELATED APPLICATIONS

This application is a division of U.S. application Ser. No. 337,185, filed Mar. 1, 1973, now U.S. Pat. No. 3,856,690, which in turn is a continuation-in-part of U.S. application Ser. No. 126,891, filed Mar. 22, 1971 and now abandoned.

BACKGROUND OF THE DISCLOSURE

1. Field of the Invention

This invention relates to the inhibition of oxidation in lubricants. More particularly, the invention has to do with lubricants in which have been placed an additive having the ability to reduce oxidation of such lubricant. Still more particularly, the additive of this invention may be referred to as an ester of an N-naphthyl anthranilic acid.

2. Discussion of the Prior Art

Lubricants, such as lubricating oils and greases, are subject to oxidative deterioration at elevated temperatures or upon prolonged exposure to the elements. Such deterioration is evidenced, in many instances, by an increase in acidity and in viscosity, and when the deterioration is severe enough, it can cause metal parts to corrode. Additionaly, severe oxidation leads to a loss of lubrication properties of the lubricants, and, in especially severe cases, to complete breakdown of the device being lubricated. In combatting oxidation, many additives have been tried, but many of them are only marginally effective except at high concentrations, especially when the lubricant is subjected to drastic oxidizing conditions.

There are patents which disclose certain anthranilic acid esters as antioxidants. U.S. Pat. Nos. 2,369,090 and 2,390,943 disclose methylanthranilate for this purpose in a petroleum or hydrocarbon oil. U.S. Pat. No. 2,369,090 also teaches the use of ethyl, propyl or butyl anthranilate. U.S. Pat. No. 3,642,632 is concerned with the $C_1$–$C_{10}$ alkyl anthranilates and those N-substituted anthranilates where the substituent is a $C_1$–$C_6$ alkyl or phenyl. Such anthranilates are said to be effective antioxidants, especially for synthetic ester oils. It will be shown that the N-naphthyl anthranilates used in the practice of this invention are unexpectedly superior to those disclosed in the patents mentioned.

SUMMARY OF THE INVENTION

In accordance with the invention, there is provided a lubricant composition comprising a major amount of a lubricant and an amount sufficient to impart antioxidant properties thereto of an ester of an N-naphthyl anthranilic acid.

DESCRIPTION OF SPECIFIC EMBODIMENTS

The anthranilic acid ester which is useful in the practice of this invention has the formula

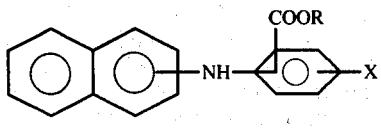

R is an alkyl group having from 1 to about 20 carbon atoms and X is selected from the group consisting of hydrogen, halogen (e.g., chlorine, bromine, iodine, fluorine), alkoxy or alkyl of from about 4 to about 20 carbon atoms, nitro, and cyano.

In general, these compounds may be prepared in known ways from the appropriate carboxylic acid or acyl halide and alcohol. The esterification is not critical, and will depend largely upon the size and type of the alcohol being used. Thus the reaction can be run at from about 50° C. to, but not including, the decomposition temperature of the product. In general, the temperature will range from about 50° C. to about 250° C.

It is generally preferred that an organic reaction medium be present during the reaction. Inert organic media may be used, in which case those including benzene, toluene, xylene, chlorobenzene and the like may be selected. In some instances it may be appropriate to use a large excess of the alcohol employed as the esterifying member.

When used as antioxidants, the products disclosed herein are effective at a concentration of from about 0.005% to about 15% by weight of the lubricant. Preferably, such concentration shall be from about 0.01% to about 10% by weight thereof, and more preferably from about 1.0% to about 5.0% by weight.

The compounds are useful in a variety of lubricants. Those which may be improved by adding an anthranilic acid ester thereto are mineral and synthesized lubricating oils, as well as greases made therefrom. The mineral oils will be understood to embrace not only the paraffinic, but also the naphthenic and aromatic-containing members. By synthesized oils are meant synthesized hydrocarbons, polyalkylene oxide oils, polyacetals, polysilicones and the like, as well as synthetic ester oils. Of the latter type there may be mentioned those esters made from monohydric alcohols and polycarboxylic acids, such as 2-ethylhexyl azelate and the like, and those made from polyhydric alcohols and aliphatic monocarboxylic acids. Those of this group are especially important, and they include esters prepared from the polymethylols, as for example the trimethylols, such as the ethane, propane and butane derivatives thereof, 2,2-disubstituted propane diols and the pentaerythritols with aliphatic monocarboxylic acids containing from about 4 to about 9 carbon atoms. Mixtures of these acids may be used to prepare the esters. Preferred in the practice of this invention are the esters prepared from a pentaerythritol and a mixture of $C_5$–$C_9$ acids. In making such esters, a generally acceptable product can be made from commercial pentaerythritol containing about 88% of monopentaerythritol and 12% dipentaerythritol.

Having described the invention in general terms, the following is offered as a specific embodiment thereof. It will be understood that the example is merely for the purpose of illustration, and that there is no intention to limit the scope of the invention to the member shown.

EXAMPLE 1

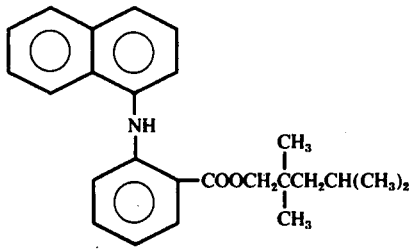

2,2,4-Trimethylpentyl N-Naphthylanthranilate

A mixture of 8.1 g. of N-phenyl-1-naphthylamine-2'-carboxylic acid chloride, 4.7 g. of 2,2,4-trimethyl-1-pentanol and 100 ml of benzene was heated at reflux for 6 hours and filtered hot. The filtrate was extracted with 10% potassium hydroxide solution, washed with water, and dried. Solvent and unreacted alcohol were removed by distillation. The ester product was obtained from the residue as viscous yellow oil.

Anal.Calc'd for $C_{25}H_{29}O_2N$: C, 79.96: H, 7.78; N, 3.73. Found: C, 79.32; H, 7.69; N, 3.88.

EXAMPLE 2

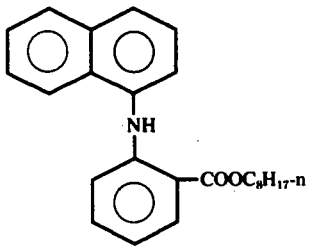

n-Octyl N-Naphthyl-4-Chloroanthranilate

A mixture of 90 g. of N-phenyl-1-naphthylamine-2'-carboxylic acid, 455 g. of 1-octanol, and 3 g. of p-toluenesulfonic acid was heated at 175°–182° C. for a total time of about 8 hours. The reaction mixture was allowed to cool, was stirred vigorously with an aqueous potassium carbonate solution and was finally extracted with benzene. The benzene extract was washed with water and dried. The ester product was isolated by distillation of the residue after removal of the solvent and unreacted alcohol as a moderately viscous pale yellow oil, b.p. 220° C. at less than 0.1 mm.

Anal.Calc'd for $C_{25}H_{29}O_2N$: C, 79.96; H, 7.78; N, 3.73. Found: C, 80.31; H, 7.60; N, 3.98.

EXAMPLE 3

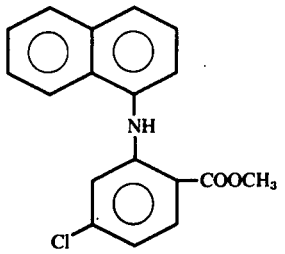

Methyl N-Naphthyl-4-Chloroanthranilate

A solution of 28 g. of N-(5-chlorophenyl)-1-naphthylamine-2'-carboxylic acid in 300 ml of methanol was refluxed at 68°–74° C. while a moderate gas stream of hydrogen chloride was passed through for about 4 hours. Excess methanol was distilled from the reaction mixture, the residue was taken up in ether and extracted with aqueous potassium hydroxide solution to remove unreacted carboxylic acid, and the ether solution was dried. The methyl ester of the acid was isolated from the residue after removal of the ether solvent as a crystalline solid m.p. 118°–122° C.

Anal. Calc'd: N, 4.50; Cl, 11.4. Found: N, 4.41; Cl, 10.9.

The following examples are offered for purposes of comparison.

EXAMPLE 4

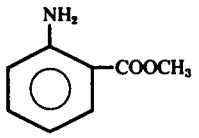

Methyl Anthranilate

Made by conventional esterification of anthranilic acid with methanol and an acid catalyst.

EXAMPLE 5

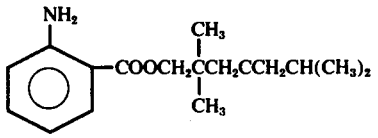

2,2,4-Trimethylamyl Anthranilate

To 39 g. of 2,2,4-trimethyl-1pentanol there was added 0.5 g. of sodium slivers and the mixture was heated at 90° C. for several hours. The reaction mixture was cooled to 60° C., unreacted sodium was removed, 45.5 g. of methyl anthranilate was added, and the mixture was heated at 90° C. for 2 hours. Solids were removed by filtration. The anthranilic acid ester product was isolated from the filtrate by distillation as a pale yellow liquid, b.p. 149° C. at about 1 mm.

Anal. Calc'd for $C_{15}H_{23}O_2N$: C, 72.25; H, 9.30; N, 5.62. Found: C, 71.86; H, 9.02; N, 5.59.

EXAMPLE 6

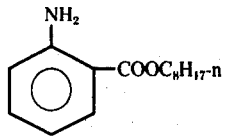

n-Octyl Anthranilate

To a methanolic solution of sodium methoxide (prepared from 30 ml of methanol and 0.2 g. of sodium) were added 91 g. of methyl anthranilate and 78 g. of 1-octanol. The reaction mixture was heated at 90° C. for 0.75 hour and at 125° C for 0.75 hour while methanol was removed by distillation. The residue was washed with water, dried, and distilled. n-Octyl anthranilate was obtained as a clear liquid, b.p. 139°–144° C at about 0.5 mm.

Anal. Calc'd for $C_{15}H_{23}O_2N$: C, 72.25; H, 9.30; N, 5.62. Found: C, 72.35; H, 8.98; N, 5.55.

EXAMPLE 7

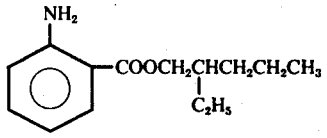

2-Ethylhexyl Anthranilate

By the method of Example 6, the reaction of 78 g. of 2-ethylhexanol and 91 g. of methyl anthranilate produced the ester 2-ethylhexyl anthranilate as a clear pale yellow liquid distillate fraction, b.p. 150°–155° C. at less than 1 mm.

Anal. Calc'd for $C_{15}H_{23}O_2N$: C, 72.25; H, 9.30; N. 5.62. Found: C, 72.98; H, 9.31; N, 5.55.

EXAMPLE 8

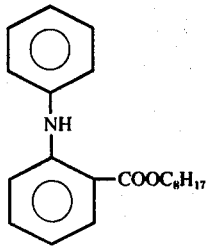

n-Octyl N-Phenylanthranilate

A mixture of 53.3 g. of N-phenylanthranilic acid, 130.2 g. of 1-octanol and 1.5 g. of p-toluenesulfonic acid was heated at 175°–180° C. for 4 hours. The reaction mixture was cooled, washed with 10% aqueous potassium carbonate solution, dried, and distilled. The ester n-octyl N-phenylanthranilate was obtained as a distillate fraction, b.p. 195° C. at less than 0.1 mm.

Anal. Calc'd for $C_{21}H_{27}O_2N$: C, 77.50; H, 8.36; N, 4.30. Found: C, 77.08; H, 8.22; N, 4.33.

EXAMPLE 9

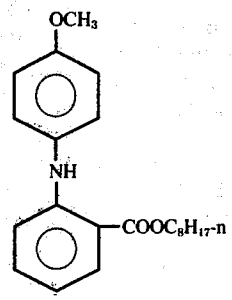

n-Octyl N-4-Methoxyphenylanthranilate

By the method of Example 8, a mixture of 48.6 g. of N-4-methoxyphenylanthranilic acid, 130.2 g. of 1-octanol and 2 g. of p-toluenesulfonic acid was heated at 130° C. for 3.25 hours. The ester n-octyl N-4-methoxyphenylanthranilate was obtained as a liquid distillate fraction, b.p. 230° –235° C. at less than 0.1 mm pressure.

Anal. Calc'd for $C_{22}H_{29}O_3N$: C, 74.33; H, 8.22; N, 3.94. Found: C, 75.00; H, 8.09; N, 3.85.

EXAMPLE 10

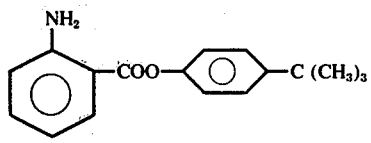

p-tert-Butylphenyl Anthranilate

To 112.5 g. of p-tet-butylphenol heated at 100°–120° C. there was added in portions 123 g. of isatoic anhydride during about 0.75 hour. The reaction mixture was allowed to cool and was then extracted with hot ethyl alcohol from which the crude ester crystallized upon cooling. Recrystallization from n-heptane afforded the crystalline ester mp 142° –143° C.

Anal. Calc'd for $C_{17}H_{19}O_2N$: C, 75.81; H, 7.11; N, 5.20. Found: C, 75.75; H, 7.05; N, 5.32.

EXAMPLE 11

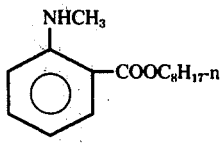

n-Octyl N-Methylanthranilate

To 65 g. of 1-octanol heated at 108° C. there was added 53.1 g. of N-methylisatoic anhydride in portions during 3.5 hours and the reaction mixture was further heated at 108° C. for 1.75 hours after addition was completed. The reaction mixture was distilled to remove unreacted octanol and to afford the n-octyl N-methylanthranilate as the liquid distillate fraction, b.p. 160° –168° C at less than 0.1 mm pressure.

EVALUATION OF PRODUCTS

The compounds produced in accordance with this invention were blended into a synthetic ester oil lubricant (made by reacting pentaerythritol with an equimolar mixture of $C_5$ and $C_9$ monocarboxylic acids) and tested in an oxidation test in accordance with the following procedure.

A sample of the test composition is heated and air at the rate of about 5 liters per hour is passed through for a period of about 24 hours. Present in the test sample are specimens of iron, copper, aluminum, and lead. It should be noted that the metals are typical metals of engine or machine construction, and they also provide some catalysis for the oxidation of organic materials.

As will be seen from the tables that follow, two different measures of the antioxidant effectiveness of the additive are shown. One is change in acidity, determined in terms of change in neutralization number (ΔNN). Superiority of an additive over the untreated lubricant or over another additive is indicated by a smaller change in acid number. The other measure is change in viscosity (ΔKV) and the smaller the noted change, the better is the additive.

In the following, Table I summarizes the results obtained with the N-naphthyl anthranilates of this invention; Table II shows the results obtained with the anthranilate, the N-alkyl and the N-phenyl anthranilate.

TABLE I

| Additive | Wt. % | Temp., ° F | Acidity, NN Final | Acidity, NN ΔNN | Viscosity, KV, 100° F Final | Viscosity, KV, 100° F ΔKV% |
|---|---|---|---|---|---|---|
| 2,2,4-Trimethylpentyl N-naphthylanthranilate | 4 | 425 | 0.79 | 0.69 | 35.65 | 25 |
| | 2 | | 0.26 | 0.21 | 32.78 | 15 |
| | 1 | | 0.79 | 0.76 | 31.50 | 11 |
| " | 4 | 450 | 1.6 | 1.50 | 38.13 | 35 |
| | 2 | | 2.6 | 2.55 | 35.79 | 26 |
| | 1 | | 5.6 | 5.57 | 82.88 | 191 |
| n-Octyl N-naphthylanthranilate | 4 | 425 | 0.77 | 0.51 | 31.53 | 19 |
| | 2 | | 1.0 | 0.87 | 30.91 | 17 |
| | 1 | | 0.64 | 0.57 | 31.74 | 19 |
| | 4 | 450 | 1.6 | 1.34 | 35.95 | 35 |
| | 2 | | 2.7 | 2.57 | 36.99 | 39 |
| | 1 | | 4.6 | 4.52 | 51.41 | 93 |
| Methyl N-naphthyl-4-chloro-anthranilate | 2 | 425 | 1.5 | 0.3 | 34.97 | 25 |
| | 1 | | 1.2 | 0.6 | 32.44 | 16 |
| Methyl anthranilate | 8 | 425 | 2.6 | 2.55 | 39.44 | 65 |
| | 4 | | 6.7 | 6.67 | 58.13 | 144 |
| " | 8 | 450 | 6.4 | 6.35 | 59.33 | 148 |
| | 4 | | 9.9 | 9.87 | 65.97 | 176 |
| | | | 13.8 | 13.78 | 93.52 | 290 |
| n-Octyl N-1-naphthylanthranilate | 4 | 450 | 1.7 | 1.60 | 34.94 | 25 |
| | 2 | | 2.5 | 2.45 | 37.20 | 83 |
| | 1 | | 7.3 | 7.27 | 100.58 | 280 |

TABLE II

| Additive | Wt. % | Temp., ° F | Acidity, NN Final | Acidity, NN ΔNN | Viscosity, KV, 100° F Final | Viscosity, KV, 100° F ΔKV% |
|---|---|---|---|---|---|---|
| 2,2,4-Trimethylamyl anthranilate | 4 | 425 | 3.5 | 3.40 | 57.05 | 114 |
| | 2 | | 4.9 | 4.85 | 66.59 | 150 |
| | 1 | | 4.9 | 4.87 | 66.46 | 148 |
| " | 6 | 450 | 14.4 | 14.29 | 69.71 | 160 |
| | 3 | | 9.0 | 8.94 | 99.41 | 271 |
| | 1.5 | | 6.0 | 5.97 | 102.5 | 284 |
| " | 8 | 450 | 4.6 | 4.49 | 59.12 | 120 |
| | 4 | | 7.6 | 7.54 | 80.03 | 197 |
| n-Octyl anthranilate | 8 | 450 | 8.6 | 8.55 | 58.64 | 130 |
| | 4 | | 6.7 | 6.67 | 70.32 | 175 |
| | 2 | | 6.1 | 6.08 | 92.18 | 260 |
| 2-Ethylhexyl anthranilate | 8 | 450 | 5.3 | 5.25 | 64.05 | 144 |
| | 4 | | 5.6 | 5.57 | 76.73 | 192 |
| | 2 | | 11.0 | 10.98 | 110.2 | 320 |
| n-Octyl N-phenyl anthranilate | 4 | 425 | 7.0 | 6.94 | 83.95 | 222 |
| | 2 | | 7.8 | 7.77 | 105.6 | 305 |
| | 1 | | 7.8 | 7.78 | 44.73 | 72 |
| " | 4 | 450 | 7.0 | 6.94 | 97.49 | 271 |
| | 2 | | 6.7 | 6.67 | 92.61 | 255 |
| | 1 | | 8.1 | 8.08 | 157.6 | 505 |
| n-Octyl N-4-methoxyphenyl-anthranilate | 8 | 450 | 2.1 | 1.99 | 75.96 | 186 |
| | 4 | | 6.0 | 5.94 | 111.8 | 326 |
| | 2 | | 8.4 | 8.37 | 78.40 | 196 |
| Phenyl anthranilate | 8 | 450 | 7.4 | 7.34 | 65.25 | 136 |
| | 4 | | 6.7 | 6.67 | 65.67 | 136 |

TABLE II-continued

| Additive | Wt. % | Temp., ° F | Acidity, NN Final | Acidity, NN ΔNN | Viscosity, KV, 100° F Final | Viscosity, KV, 100° F ΔKV% |
|---|---|---|---|---|---|---|
| p-t-Butylphenyl anthranilate | 8 | 425 | 4.5 | 4.45 | 44.51 | 42 |
| | 4 | | 4.3 | 4.27 | 47.75 | 52 |
| | 2 | | 8.7 | 8.68 | 69.0 | 120 |
| " | 8 | 450 | 6.2 | 6.15 | 62.22 | 98 |
| | 4 | | 6.7 | 6.67 | 83.88 | 167 |
| | 2 | | 9.5 | 9.48 | 119.7 | 284 |
| Octyl N-methyl anthranilate | 6 | 425 | — | 2.62 | 38.71 | 57 |
| | 3 | | 5.0 | 4.83 | 51.52 | 109 |
| | 1.5 | | 6.2 | 6.11 | 83.35 | 237 |
| " | 6 | 450 | 7.8 | 7.46 | 51.73 | 110 |
| | 3 | | 4.2 | 4.03 | 39.74 | 61 |
| | 1.5 | | 6.7 | 6.62 | 84.28 | 241 |

It can be seen from the above tables that in virtually every instance in which a direct comparison can be made (i.e. conditions of temperature and concentration the same) the N-naphthyl anthranilate is unexpectedly superior to those disclosed in the references discussed hereinabove.

The usual criteria for determining the antioxidant activity of an additive in a lubricant include changes in acidity and viscosity. It is recognized in this art, however, that while an additive may give control in these two areas, it may have little or no effect in other areas, such as in controlling sludge formation and lead loss.

Furthermore, while the single additive may be effective, more activity may be required than can be obtained with the additive above. In such cases it is sometimes advantageous to add another material. In the present invention, it has been found that p-p'-dioctyldiphenylamine (DODPA) may be used to advantage.

Consider the data below obtained at 450° F in the above ester lubricant.

| Additive | % by Wt.* | ΔNN | ΔKV,% | Pb Loss | Sludge |
|---|---|---|---|---|---|
| 1) n-octyl N-naphthyl-anthranilate | 4 | 1.34 | 35 | 9.7 | nil |
| | 2 | 2.57 | 39 | 24.6 | medium |
| 2) 1) + 1% DODPA | 4 | 1.29 | 50 | 1.7 | nil |
| | 2 | 1.94 | 49 | 1.4 | nil |

*- % of N-octyl N-naphthylanthranilate

It may be seen from the data with the anthranilate alone that the use of DODPA with n-octyl-N-naphthylanthranilate gives improvement not only in sludging (at 2% level) but also in the acid values and lead loss. Thus, at the 4% level of additive, sludging was not affected, but the lead loss was reduced considerably and there was a small reduction in acid value. The greatest effect of the second additive shown by the data is at the 2% level. Here sludging is reduced from a "medium" rating to "nil," the lead loss is reduced about 23 mg. and the acid value is reduced significantly.

While the optimum amount of DODPA that may be used is not known, it is believed that DODPA may be used with the other additive in a ratio of from 4:1 to 1:4 when using a total additive concentration of from about 0.5% to about 15% by weight.

I claim:

1. A compound of the formula

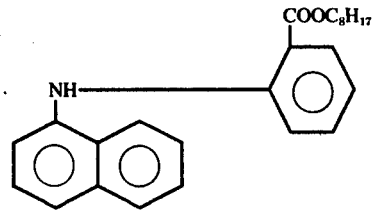

wherein $C_8H_{17}$ is 2,2,4-trimethylpentyl.

* * * * *